United States Patent [19]

Crutcher

[11] Patent Number: 4,986,164

[45] Date of Patent: Jan. 22, 1991

[54] PNEUMATIC GUN HAVING IMPROVED FIRING VALVE

[75] Inventor: John P. Crutcher, Cincinnati, Ohio

[73] Assignee: Senco Products, Inc., Cincinnati, Ohio

[21] Appl. No.: 365,759

[22] Filed: Jun. 13, 1989

Related U.S. Application Data

[63] Continuation of Ser. No. 225,348, Jul. 28, 1988, abandoned, which is a continuation of Ser. No. 130,303, Dec. 9, 1987, abandoned, which is a continuation of Ser. No. 503,843, May 31, 1988, Pat. No. 4,747,338.

[51] Int. Cl.[5] ..... F15B 11/08

[52] U.S. Cl. ..... 91/461; 92/98 D; 251/120

[58] Field of Search ..... 91/399, 401, 417 A, 91/461; 251/61, 61.2, 120; 92/98 D

[56] References Cited

U.S. PATENT DOCUMENTS

| | | | |
|---|---|---|---|
| 691,190 | 1/1902 | Sharp . | |
| 1,414,835 | 5/1922 | Spohrer | 92/98 D |
| 1,967,314 | 7/1934 | Lloyd . | |
| 2,315,370 | 3/1943 | Hughes | 251/120 X |
| 2,721,579 | 10/1955 | Sexton . | |
| 2,861,456 | 11/1958 | Soderberg . | |
| 3,027,875 | 4/1962 | Spencer | 91/DIG. 3 |
| 3,087,162 | 4/1963 | Saureman et al. . | |
| 3,094,900 | 6/1963 | Wandel et al. | 91/415 X |
| 3,147,670 | 9/1964 | Spencer | 91/415 |
| 3,169,452 | 2/1965 | Dugin . | |
| 3,170,487 | 2/1965 | Juilfs et al. . | |
| 3,375,758 | 4/1968 | Novak et al. | 91/461 X |
| 3,382,954 | 5/1968 | Charlson | 74/18.2 X |
| 3,405,609 | 10/1968 | Lee . | |
| 3,527,142 | 9/1970 | Obergfell . | |
| 3,587,408 | 6/1971 | Haase et al. | 251/61.2 X |
| 3,815,475 | 6/1974 | Howard et al. . | |
| 3,835,899 | 9/1974 | Holder, Jr. | 251/61.2 X |
| 4,450,688 | 5/1984 | Boehm | 60/547.1 X |
| 4,706,685 | 11/1987 | Jones et al. . | |

FOREIGN PATENT DOCUMENTS

| | | | |
|---|---|---|---|
| 490439 | 2/1953 | Canada | 251/61.2 |
| 0007534 | of 1979 | European Pat. Off. . | |
| 0052368 | 6/1982 | European Pat. Off. . | |
| 2604287 | 2/1976 | Fed. Rep. of Germany . | |
| 0190696 | of 1979 | New Zealand . | |

OTHER PUBLICATIONS

Advertisement for Bellofram Rolling Diaphragm in *Machine Design* (1983).

*Primary Examiner*—Edward K. Look
*Attorney, Agent, or Firm*—Wood, Herron & Evans

[57] ABSTRACT

A pneumatic gun having an improved firing valve is disclosed wherein the firing valve is sealingly secured to the housing of the gun by a pair of rolling diaphragm seals. On the underside of the firing valve, there is a deflector having a downwardly curled outer edge operative to direct air flow into the top of the cylinder upon opening of the firing valve. The firing valve is so configured that exposure of multiple differential areas of the valve to a common high pressure results in the valve being biased toward a sealed position relative to the cylinder of the gun while in the unfired position.

12 Claims, 4 Drawing Sheets

PNEUMATIC GUN HAVING IMPROVED FIRING VALVE

This is a continuation of application Ser. No. 07/225,348, filed July 28, 1988, which in turn was a continuation of U.S. Pat. Application Ser. No. 07/130,303, filed Dec. 9, 1987 (now abandoned) which in turn was a continuation of U.S. Pat. Application Ser. No. 07/503,843 filed May 31, 1988, now U.S. Pat. No. 4,747,338.

This invention relates to pneumatic guns and more particularly to an improved firing valve for use with such guns.

Pneumatic guns for driving nails or staples are common in the commercial market. Typically, such pneumatic guns comprise a generally gun-shaped housing within which there is a cylinder containing a driving piston. This piston carries a hammer blade which is adapted to be moved past the opening of a magazine containing a roy of staples or mails to be sequentially driven by the hammer blade. As the hammer blade moves past the opening in the magazine, it engages the endmost staple or nail, causing that endmost staple or nail to be separated from the remaining staples or nails and driven into a structure. The hammer blade then is lifted or retracted, from its fired or downward position which blocks the opening of the magazine, to permit the next following nail or staple contained in the magazine to be urged forwardly into a position wherein the next fastener is directly below the hammer blade preparatory to the next stroke of the hammer blade.

Reciprocation of the piston within the cylinder of such prior art guns is commonly effected by a valve mechanism operable to supply air under pressure to the top side of the piston so as to drive it downwardly, or to the underside of the piston while the top side is connected to exhaust so as to drive the piston upwardly. The valve mechanism which controls this piston reciprocation generally comprises a trigger operated valve and a firing valve. The firing valve alternatively supplies high pressure air to the top side of the piston or connects the top side of the piston to exhaust.

One of the most important characteristics of a pneumatic gun is that the firing valve of the gun be very quick acting so as to impart maximum power to the driving piston and attached hammer blade. That power is a function of the velocity of the piston which is in turn a function of the speed with which the firing valve opens so as to deliver the maximum air flow and pressure to the piston as rapidly as possible and thereby maximize the velocity of the piston in its downward hammer stroke.

It has been one objective of this invention to provide an improved pneumatic gun firing valve which opens more quickly than prior art firing valves and therefore imparts increased velocity to the piston and attached hammer blade controlled by the firing valve.

One of the most common problems encountered by all manufacturers of pneumatic guns is that of frequency of service calls required to repair failed guns. Most of the service calls are traceable to failed seals in the gun, and quite commonly those failed seals are the seals associated with the firing valve. Upon failure of these seals, the gun ceases to operate, or alternatively delivers so little power as to effectively render the gun useless.

As presently configured, most pneumatic guns utilize either O-ring seals or diaphragm seals throughout the guns. When O-ring seals are used in pneumatic guns, though, the seals lack lubrication of the type which is usually present when such seals are utilized in hydraulic applications. Because of the absence of any lubrication, O-ring seals in pneumatic guns are generally characterized by a relatively short life. Additionally, the air systems used in association with pneumatic guns often contain contaminants which act as abrasives to further shorten the life of the O-ring seals.

The alternative to using O-ring seals in pneumatic guns has in the past been to use diaphragm seals. Diaphragm seals, though, are subject to being stretched, and since there is a limit to the amount of stretch which may be imparted to a given diameter of diaphragm seal, the diameter of the seals must be increased to obtain larger strokes of the valve. Consequently, the tops of diaphragm sealed tools are usually larger than O-ring sealed tools. And, of course, it is always desirable to minimize the size of any hand tool. Accordingly, for the most part, O-ring sealed tools have heretofore been more common than diaphragm sealed tools.

Whether the pneumatic guns use diaphragm seals or O-ring seals, they are still subject to too frequent failure of the seals and resulting breakdown of the gun. It has therefore been an objective of this invention to provide an air gun which is less subject to seal failure and to the need for repair than prior art guns.

Still another objective of this invention has been to provide an improved sealing system for the firing valve of an air or pneumatic gun which is less subject to failure and need for repair than prior art guns.

These objectives are achieved and one aspect of this invention is predicated upon the concept of utilizing rolling diaphragm seals in place of prior art O-ring seals or flat diaphragm seals in association with the firing valve of a pneumatic gun.

The pneumatic fastener driving tool of this invention which accomplishes these objectives comprises a housing having a handle and a trigger actuated valve associated with that handle. The trigger actuated valve is operative to control displacement of a firing valve. This firing valve in turn controls reciprocation of a piston within a cylinder contained within the housing. The piston has a hammer blade attached to the lower side thereof facing the bottom of the cylinder. When the trigger valve is actuated, the top side of the firing valve is vented to atmosphere through the trigger valve and thereby the firing valve is lifted upwardly by high pressure air acting upon the underside of the firing valve to move the firing valve from sealed engagement with the top surface of the cylinder. As the firing valve is lifted upwardly from sealed engagement with the cylinder, air from an air chamber contained in the housing is dumped into the top of the cylinder, thereby causing the piston and attached hammer blade to be driven downwardly. Upon release of the manual trigger, the top side of the firing valve is connected through the trigger valve to high pressure air from the housing chamber and the firing valve is thereby caused to move downwardly and seat on the cylinder, thereby connecting the top side of the piston to exhaust through the firing valve, while high pressure air entrapped beneath the piston causes the piston and attached hammer blade to return to its raised position.

The firing valve of the pneumatic gun of this invention contains top and bottom surfaces of different areas thereof and has an axial bore extending through the firing valve and through an exhaust valve stem attached to the top of the firing valve. Downward movement and sealing of the firing valve upon the top surface of the cylinder when high pressure air is supplied to the top side of the firing valve is effected by differential areas of the firing valve being exposed to the same common high pressure while simultaneously, the same high pressure acts upon the top of the exhaust valve stem. Exposure of these three different areas to the same common pressure results in the firing valve being moved downwardly and back into sealed engagement with the top of the cylinder, thereby exhausting the top side of the piston to atmosphere via the axial bore and exhaust valve stem.

One of the novel aspects of this pneumatic gun is that of having the firing valve connected to the housing by a pair of rolling diaphragm seals, which seals are connected to the top and bottom of the firing valve chamber of the housing. These seals enable the firing valve to be reciprocated within the firing valve chamber without any frictional rubbing between the seal and the valve such as occurs with conventional O-ring seals.

Still another novel aspect of this invention is predicated upon the use of a diverter attached to the underside of the firing valve and engageable with the top side of the cylinder. This diverter is of larger diameter than the top side of the cylinder and extends beyond the periphery of the top side of the cylinder. It curls downwardly so that when the top side of the firing valve is exposed to atmospheric pressure, high pressure air acting upon the underside of this diverter causes the firing valve to lift upwardly. As soon as the firing valve and attached diverter lift off of the cylinder, the diverter acts to direct air at a high velocity to the interior of the cylinder. It has been found that this downwardly curled lip on the diverter has the effect of directing air flow onto the top of the cylinder so as to increase the power and velocity of the piston.

The primary advantage of this invention is that it eliminates either O-rings or conventional flat diaphragm seals between the firing valve and the housing of a pneumatic fastener driving tool. Substitution of a rolling diaphragm seal for the conventional flat diaphragm seal or for the conventional O-ring seals has resulted in a fastener driving tool which has a longer life and which is less subject to failure than tools which incorporate either flat diaphragm seals or O-ring seals As compared to pneumatic guns which utilize flat diaphragm seals between the firing valve and the housing, the invention of this application with its rolling diaphragm seals enables the size of the head of the gun to be reduced for a given power output gun.

These and other objects and advantages of this invention will be more readily apparent from the following description of the drawings in which.

Figure 1:
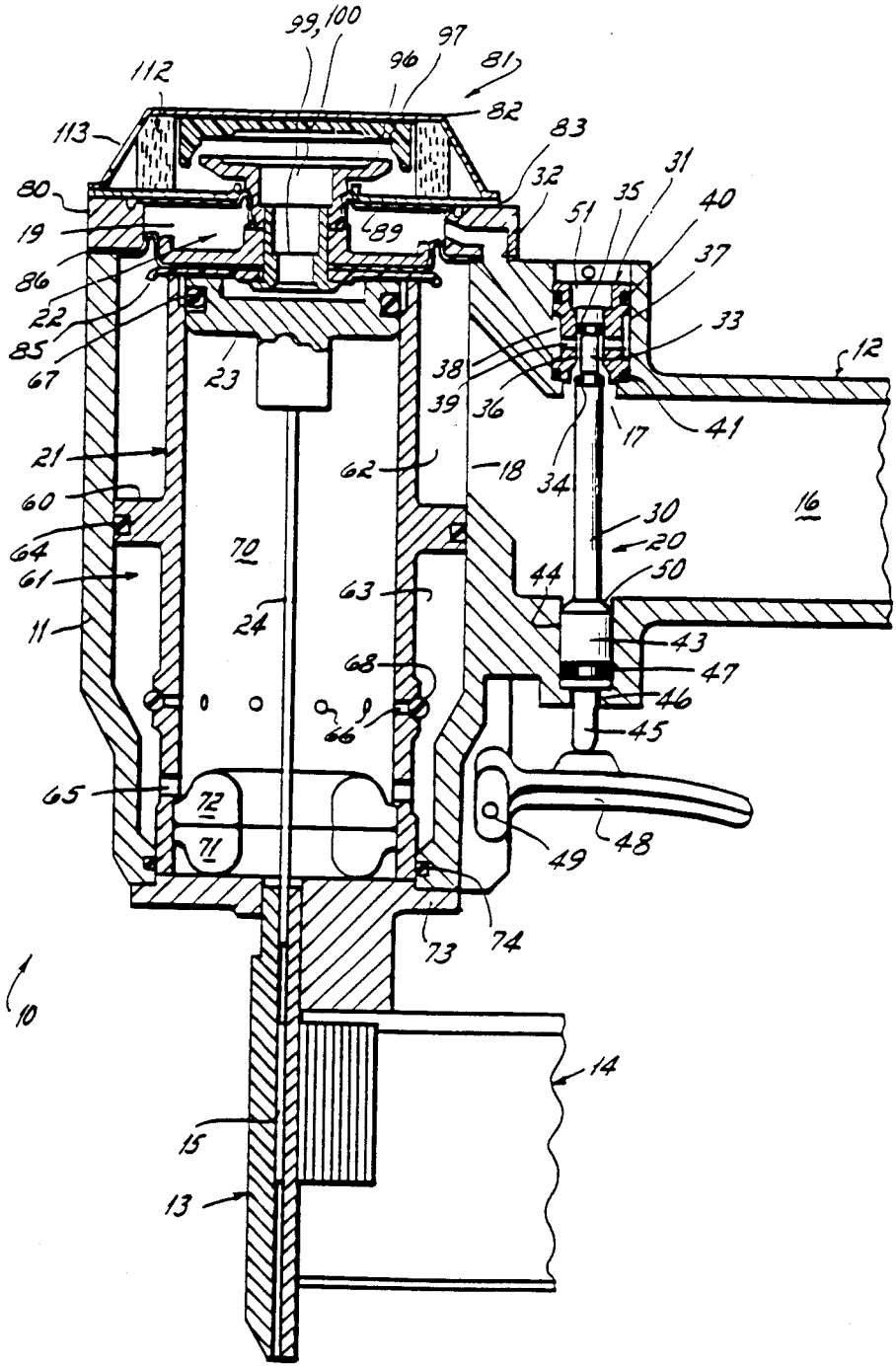
FIG. 1 is a fragmentary cross-sectional view of a pneumatic gun incorporating the invention of this application.
Figure 2:
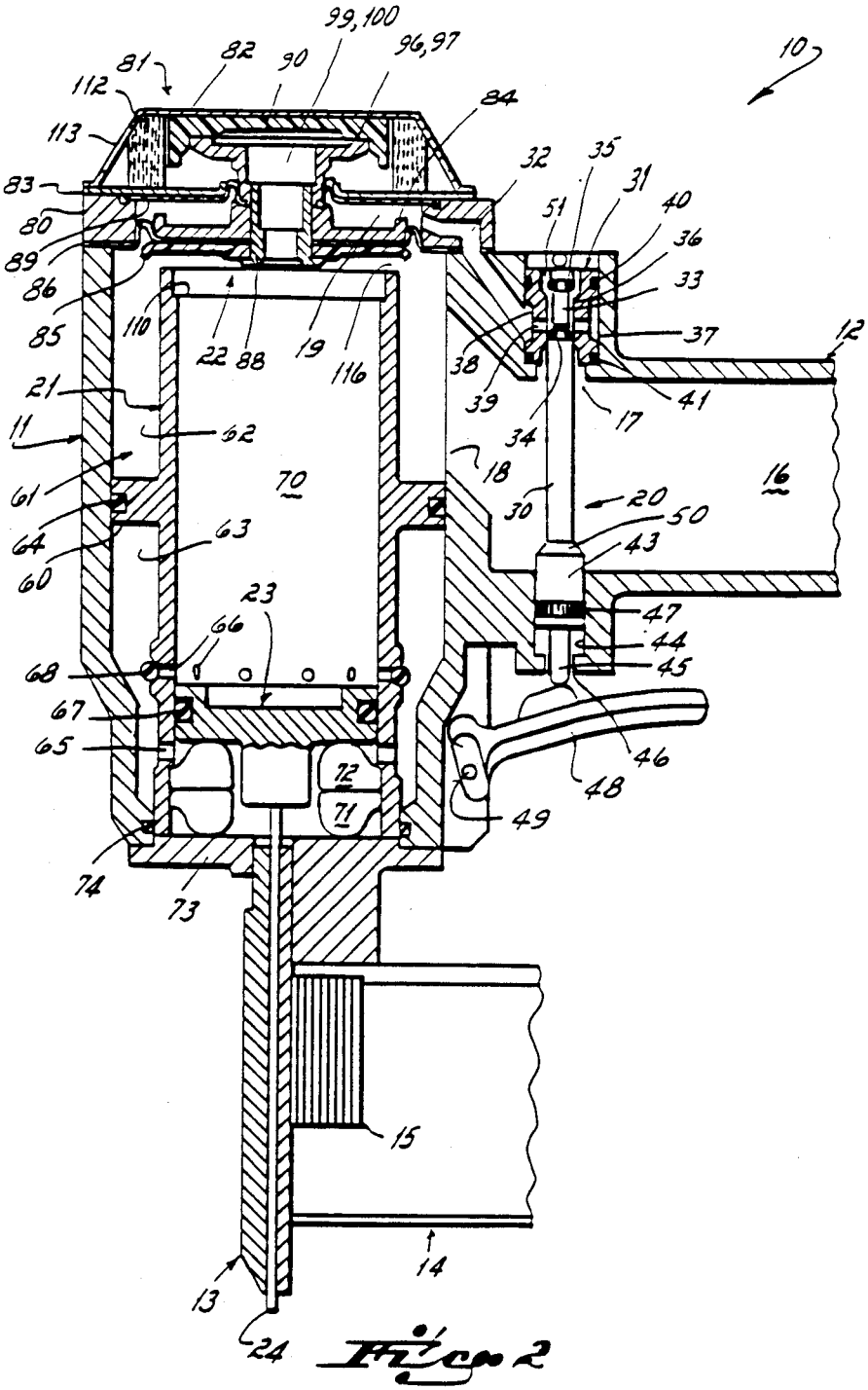
FIG. 2 is a view similar to FIG. 1, but illustrating the firing valve and the piston of the gun in different positions than is illustrated in FIG. 1.

Referring first to FIGS. 1 and 2, there is illustrated a pneumatic fastener driving gun 10 incorporating the invention of this application. This gun 10 includes a housing 11 having a handle portion 12 and a nosepiece or nose portion 13. The gun includes conventional storing and sequential feeding means 14 to provide a continuous supply of staples into the nosepiece 13. Since the supply and feeding means 14 associated with fastener guns is conventional and well-known in the prior art, the supply and feeding means 14 has not been illustrated or described herein.

The power for the pneumatic gun 10 is obtained from any suitable source of air under pressure. Conventionally, that source may be an air hose which delivers air to the gun at a pressure on the order of 85 to 100 psi. The handle portion 12 of the housing is provided with a hollow chamber 16 connected to the air pressure sources (not shown). The air chamber 16 is provided with two ports 17 and 18 through which high pressure air may escape from the chamber 16. One of these ports 17 communicates with a firing valve chamber 19 under control of a trigger controlled valve 20 while the other port 18 communicates with the interior of a cylinder 21 mounted within the housing 11. The flow of air pressure through the port 18 and into the interior of the cylinder 21 is controlled by a firing valve 22.

A piston 23 is reciprocably mounted within the interior of the cylinder 21. This piston has a hammer blade 24 extending downwardly from the underside thereof and through the nosepiece such that each reciprocation or stroke of piston 23 results in one fastener 15 being pushed downwardly by the hammer blade 24 out of the nosepiece 13.

The trigger valve 20 comprises a valve plunger 30 cooperable with a valve spool 31 to control the flow of high pressure air from the chamber 16 through the port 17 and a passage 32 into the firing 19. The upper end of plunger 30 contains a stem 33 of reduced diameter, which stem is located between a pair of O-ring seals 34, 35. The upper end of the plunger 30 including stem 33 is reciprocable within a bore 36 of the spool 31. The spool 31 is located within a bore 37 of the housing 11, which bore is open at its upper end to the atmosphere and at its lower end is open to the port 17. A groove 38 is located around the periphery of the spool 31 and is in communication with the interior bore 36 of spool 31 via radial ports 39. O-ring seals 40, 41 are located around the top and bottom of the spool 31 so as to seal the top and bottom of the spool 31 relative to the bore 37 in housing 11.

The lower end of the valve plunger 30 has an enlarged head 43 reciprocable within a bore 44 formed in the handle 12 of housing 11. The bottom of this head 43 terminates in a trigger engageable pin 45 which extends through a smaller diameter section 46 of the bore 44. An O-ring seal 47 seals the head 43 of the plunger 30 relative to the bore 44 of housing 11.

A trigger 48 is engageable with the bottom of the pin 45. This trigger 48 is mounted upon housing 11 by a pivoted pin 49. It is normally biased downwardly by the trigger engageable pin 45 as a consequence of air pressure within the chamber 16 acting upon the shoulder 50 of the plunger to force the plunger 30 and attached pin 45 downwardly. When trigger 48 is pulled upwardly by a person using the gun, this downwardly acting force on the plunger is overcome by the force on the trigger 48.

As shown in FIG. 1, in the lower position of the plunger 30, before the plunger is acted upon by the trigger 48, firing chamber 19 is exposed to high pressure air in chamber 16 through port 17, bore 36, ports 39 and passage 32. Referring to FIG. 2, when the trigger 48 and consequently valve 20 are moved upwardly, the O-ring seal 34 moves upwardly to seal bore 36 of spool 31 from the port 17. Simultaneously with the closing of the port 17 by the O-ring seal 34, an exhaust port 51 of the trigger valve is opened to bore 36 by movement of the upper O-ring 35 into the annular exhaust port 51. Thereby, the firing valve chamber 19 of the firing valve 22 is connected to atmospheric pressure via the passage 32, ports 39, bore 36, and the exhaust port 51. Thus, the trigger valve 20 functions to alternatively connect the firing valve chamber 19 with atmosphere via the exhaust port 51 or to the pressure chamber 16 via the port 17, depending upon whether the trigger actuated plunger 30 is in its raised position illustrated in FIG. 2 or its lowered position illustrated i FIG. 1. Irrespective of which position it is in, however, high pressure air acting on the plunger 30 always urges or biases the plunger 30 downwardly toward a position in which the firing chamber 19 is open to the air chamber 16. While not illustrated herein, an auxiliary spring may be used to supplement air pressure acting upon the trigger valve plunger 30 to urge the plunger to its lowered position. Such a spring, however, is not required for the gun 10 to operate properly.

The main cylinder 21 of the gun is generally tubular in configuration and has a peripheral flange 60 extending radially therefrom. This flange divides an air chamber 61 contained within the housing 11 into an upper chamber 62 and a loWer chamber 63. The two chambers are sealingly separated by an O-ring 64 located in the periphery of the flange 60.

The lower end of the cylinder 21 is provided with two series of ports, a lower series 65 and an upper series 66. These two series are vertically separated a distance slightly greater than the height of the piston 23. When the piston 23 is in its lowermost position (illustrated in FIG. 2) an O-ring 67 carried by the piston sealingly separates the ports 65 from the ports 66.

The upper series of ports 66 are closed by an O-ring 68 located about the periphery of cylinder 21. This O-ring 68 acts as a one-way check valve to permit egress of high pressure air from the interior 70 of the cylinder 21 through the ports 66 while preventing return of high pressure air from the chamber 63 to the interior 70 of the cylinder. Located in the bottom of the cylinder 21 there is a pair of elastomeric stops 71, 72 which act as shock absorbers between the bottom of piston 23 and a bottom wall 73 of housing 11. An O-ring seal 74 preferably seals the bottom of the cylinder 21 and the bottom of the housing 11 so that air pressure cannot escape from the lower housing chamber 63 between the bottom of cylinder 21 and housing 11.

So much of the air gun as has been heretofore described, including the trigger valve 20, the lower portion of housing 10 including the nosepiece 13, and the staple feeding means 14 as well as the cylinder 21 are conventional and form no part of the invention of this application. The invention of this application resides in the upper portion of housing 11 and the firing valve 22 contained within that upper portion.

Figure 3:
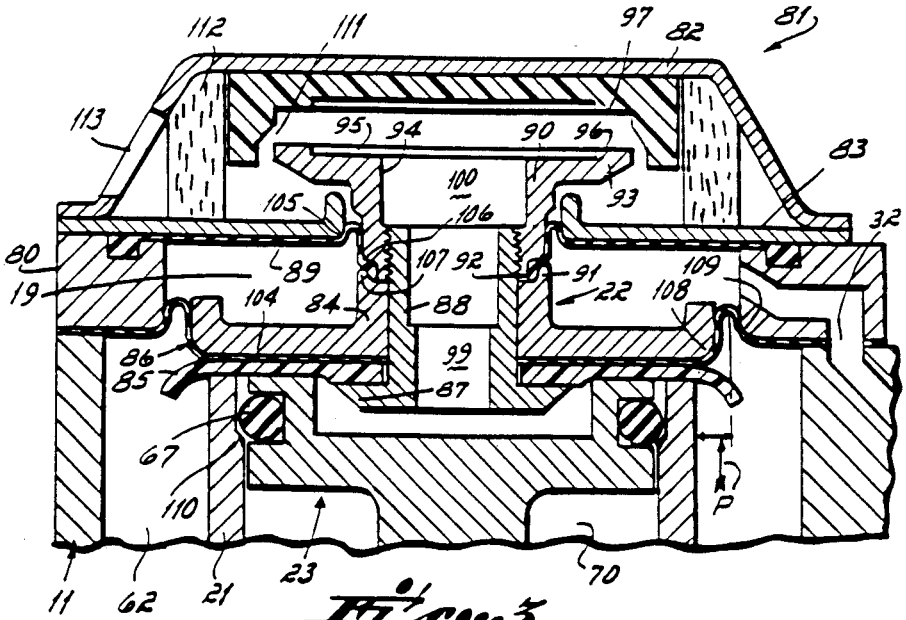
FIG. 3 is an enlarged cross-sectional view of a portion of the firing valve of the gun illustrated in FIG. 1.

Referring now to FIG. 3, the top of the housing 11 comprises a annular seal seating ring 80 and a deflector 81. Deflector 81 comprises an inverted dish shaped cap 82 mounted atop a deflector ring or base 83. The deflector 81 and annular seal seating ring 80 are fixedly secured to the top of the housing by bolts or other conventional fasteners (not shown).

The firing valve 22 is mounted for reciprocation within the top of housing 11. It comprises a firing valve piston 84 and a firing valve deflector plate 85 between which there is held captive an annular rolling diaphragm seal 86.

The outer periphery of the rolling diaphragm seal 86 is held captive between the underside of the annular seal seating ring 80 and the top of housing 11, upon which ring 80 rests. The piston 84, seal 86, and deflector 85 are annular in configuration and stacked upon the top of a radial flange 87 of a firing valve center post 88. The post 88 is hollow and is externally threaded at the top. Threaded to the top of the center post 88 of firing valve 22 is a hollow generally cylindrical exhaust stem 90.

A second rolling diaphragm seal 89 is held captive between a lip 91 on the top of the firing valve piston 84 and the bottom 92 of the exhaust stem 90. The outer edge of this second rolling diaphragm seal 89 is held captive between the top of the seal seating ring 80 and the bottom of the deflector base 83.

At its top, the exhaust stem 90 has a radial flange 93 extending outwardly from the hollow center section 94. The top of the flange 93 contains a circular recess 95 formed in the top of exhaust stem 90. Between the recess 95 and the periphery of the flange 93 there is a sealing lip 96. This lip 96 is engageable with the bottom surface of an elastomeric exhaust valve 97 fixedly secured to the underside of the deflector cap 82 so as to seal the interior of firing valve 22 from exhaust or atmosphere, as explained more fully hereinafter.

There may be a compression spring located between the underside of the elastomeric exhaust valve 97 and the top of the hollow center post 88 of firing valve 22. Such a spring has not been illustrated because it is not necessary for proper operation of the gun. However, it may be added as insurance against inadvertent prefiring of the gun.

The rolling diaphragm seals 86 and 89 are conventional seals manufactured from fabric reinforced elastomeric material. Such seals in varying sizes are readily commercially available. The advantages of such seals is that they do not rub against a sealing surface, but rather roll from one sealing surface to another. In addition, the seals are not required to stretch as the surfaces which they seal move relative to one another. Rather, the seals simply roll relative to rounded surfaces or corners of the element sealed by the rolling diaphragm. To that end it is to be noted that the inner corner 105 of the deflector base plate 83 and the corners 106, 107 of the firing valve exhaust stem 90 are all radiused so that there is no tendency for a sharp edge of those surfaces to cut into the elastomeric material from which the seal 89 is manufactured. Similarly, the outer edge 108 of the firing valve piston 84, the top surface 104 of the firing valve deflector plate 85 and the innermost corner 109 of the annular seal seating ring 80 are similarly radiused so as to facilitate rolling of the rolling diaphragm seal 86 relative to the surfaces over which it is movable.

In operation of the pneumatic gun 10, air pressure substantially above that of atmosphere is supplied to the chamber 16 of the housing 11. This pressure is generally on the order of line pressure from between 85–100 psi. When this high pressure air is supplied to gun 10, that pressure acts upon the shoulder 50 of the trigger control valve 20 to bias the plunger 30 of the trigger valve downwardly. Trigger valve 20 is maintained in its downward position as illustrated in FIG. 1 until pin 45 is acted upon by trigger 48. In this downward or lower position of the trigger valve 30, air pressure from the chamber 16 is supplied via port 17, bore 36, ports 39, and passage 32 to the firing valve chamber 19. High pressure air in chamber 19 acts upon the top side of the firing valve 22 to bias said valve downwardly to a position in which the underside of the deflector plate 85 rests atop the cylinder 21 and seals the interior 70 of cylinder 21 from the high pressure chamber 62 of housing 11. With firing valve 22 in this sealed position relative to the cylinder 21, the piston 23 is in its normal position of rest at the top of cylinder 21 as illustrated in FIGS. 1 and 3. In this raised position, the piston O-ring 67 is engaged with a peripheral groove 110 in the top of cylinder 21, which groove maintains piston 23 in its raised position unless or until high pressure air acts on the top side of the piston 23 to force it downwardly. So long as the firing valve chamber 19 is exposed to high pressure air and the firing valve 22 is seated on the top of the cylinder 21, the top side of the piston 23 is open to atmosphere via the passageway through the bore 99 in the center of firing valve 22, the bore 100 in the center of exhaust stem 90, the area 111 between the top surface of sealing lip 96 of the exhaust stem 90 and the exhaust valve 97 through an air permeable silencer material 112 and an opening 113 in the deflector cap 82.

Figure 4:
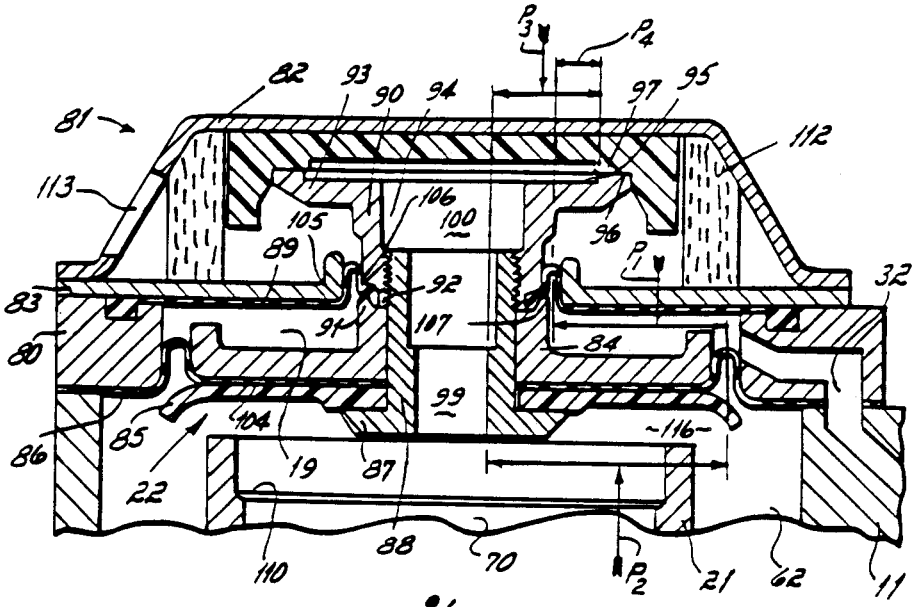
FIG. 4 is a view similar to FIG. 3, but illustrating the firing valve in a different position than is illustrated in FIG. 3; and, FIG. 5 is a cross-sectional view of a modified firing valve portion of a pneumatic gun illustrating a second embodiment of the invention of this application.

In order to fire the gun, the trigger 48 is moved upwardly against the underside of the firing valve pin 45 with sufficient force to overcome the downwardly acting pneumatic force of the line pressure upon the shoulder 50 of plunger 30. This results in the plunger 30 being lifted upwardly until the O-ring seal 34 closes the port 17 while O-ring seal 35 moves upwardly to connect trigger valve exhaust port 51 to bore 36. This results in the firing valve chamber 19 on the top side of the firing piston 22 being connected to atmosphere via passage 32, ports 39, bore 36, and the exhaust port 51. Since high pressure air is then acting upon the underside of the deflector plate 85 and seal 86, as represented by the arrow P in FIG. 3, the firing valve 22 is lifted off of the top of the cylinder 21. As soon as the valve 22 lifts off of the cylinder 21, the complete underside of the firing valve 22 is exposed to high pressure air, with the result that the firing valve 22 is kicked upwardly until the lip 96 of the exhaust stem 94 seals against the elastomeric valve 97, as shown in FIG. 4. Sealing of the exhaust valve stem 90 against the exhaust valve 97 results in high pressure air from chamber 16 flowing through a gap 116 between the underside of the deflector plate 85 and the top of the cylinder 21, filling the top of the cylinder 21 and causing the piston 23 to be driven downwardly.

It is to be noted that the outer edge of the deflector plate 85 curls downwardly or toward the cylinder 32. It has been found that this downward curl of the deflector plate 85 has the effect of driving the incoming air into the top of the cylinder 21 with the result that the downward velocity of piston 23, and thus its power output, is substantially increased. Otherwise expressed, this downward curl at the outer edge of the deflector plate 85 has been found to effect the air flow into the top of the cylinder 21 so as to increase the power and the velocity of piston 23 with the result that greater power is imparted to fasteners such as staples, driven by the hammer blade 24 attached to the underside of the piston 23.

Also, it is believed this curled edge promotes quicker reciprocating action of the firing valve and thus quicker closing of the exhaust, thus increasing efficiency.

As the piston 23 is driven downwardly, air entrapped on the underside of the piston is driven through the ports 65, 66 (FIG. 1) into the chamber 63 located on the underside of the flange 60 of cylinder 21. Chamber 63 thus fills with high pressure air at approximately the same pressure as is acting upon the top side of the piston 23. When the piston 23 reaches the bottom of the cylinder 21 and engages the elastomeric stops 71, 72, the pressure in the chamber 63 is available to return the piston 23 to its uppermost position.

The piston 23 and attached hammer blade 24 will remain at the bottom of its stroke until such time as the trigger 48 is released, thereby allowing the air pressure contained within the chamber 16 to act upon the flange 50 of the trigger valve 20 and push the trigger valve plunger 30 downwardly. This downward force on the trigger valve plunger 30 moves trigger valve 20 downwardly to the position shown in FIG. 1, wherein the uppermost O-ring seal 35 seals bore 36 from the exhaust port 51, while the high pressure inlet port 17 is opened to bore 36 as lowermost O-ring seal 34 moves downwardly. Thereby, the firing valve chamber 19 located on the top side of the firing valve 22 is subjected to high pressure air entering from port 17 via bore 36, ports 39 and passageway 32. Upon entry of this high pressure air to the firing valve chamber 19 (and assuming the firing valve to be in the raised position depicted in FIG. 1), the same high pressure air is then acting upon the underside of the firing valve 22 (indicated by arrow $P_2$ in FIG. 4), the top side of the firing valve 22 (indicated by the arrow $P_1$ in FIG. 4) and the top side of the firing valve stem 90 from the inner edge of the lip 96 to the inner extremity of the bore 99 in the firing valve (indicated by the arrow $P_3$). The force $P_2$ acting on the underside of firing valve 22 tends to drive said valve upwardly and maintain the exhaust stem lip 96 sealed to the elastomeric exhaust valve 97, but the combined force $P_1$ acting upon the top surface of the firing valve 22 and the force $P_3$ acting upon the top surface of recess 95 of the exhaust stem 90 is greater and will drive firing valve 22 downwardly. Since all three areas are subjected to the same high pressure, this greater force is the result of the differential in areas which result in a net differential force indicated by arrow $P_4$ acting downwardly to force the firing valve 22 downwardly. As soon as the exhaust valve stem 90 moves off of or out of engagement with the exhaust valve 97, the interior 70 of the cylinder 21 is opened to atmosphere via the said bores 99, 100 in the firing valve 22 and exhaust stem 90, respectively, through the area 111 between the lip 96 of the exhaust stem 90 and the exhaust valve 97, through silencer 112 and out through the port 113 in the deflector cap 82. As soon as the area 111 is established between the exhaust stem lip 96 and the exhaust valve 97, the firing valve 22 receives a downward kick or increase in downwardly acting force as a consequence of the underside of the firing valve 22 being opened to a lower pressure (atmosphere) so that all of the high air pressure forces then acting on valve 22 push downwardly.

When the interior 70 of the cylinder 21 is opened to atmosphere as a consequence of the downward movement of the firing valve 22 and movement of the exhaust stem 90 off of the exhaust valve 97, high pressure air entrapped in chamber 63 enters the cylinder 21 on the underside of the piston 23 through ports 65 and drives the piston 23 upwardly until the underside of piston 23 engages the underside of firing valve 22 and the O-ring 67 enters the groove 110 in the top of the cylinder. Piston 23 then remains in this raised position until the trigger 48 is again actuated.

It should be noted that the effective pressure areas discussed above, and as shown in the drawings with respect to the rolling diaphragm seals, are believed to be bounded or defined by the centerline of the roll of the seal between the firing valve and the housing, as shown for pressure areas P, $P_1$, $P_2$ and $P_4$ in the figures, for example. Also, it should be appreciated that the pressures discussed act over an annular area or surface of a seal deflector plate, exhaust valve stem, etc., as disclosed. The arrows in the drawings are used without limitation and for illustrative purposes to demonstrate the pressure differentials as described.

There are numerous advantages to the pneumatic gun disclosed and described hereinabove. Primary among those advantages is that there are no seals associated with the firing valve to rub together and wear. Instead, the seals roll from one wall or surface to another without any abrading between the seal and the surfaces relative to which it is movable.

The use of rolling seals also renders the pneumatic gun more tolerant of foreign or abrasive materials contained in the air stream. Since there is no rubbing between the seals of the firing valve and the housing relative to which the firing valve is movable, the presence of a small foreign body or abrasive does not result in excessive wear.

Additionally, no stretching of a seal is required with each stroke of the firing valve as is the case with conventional flat diaphragm seals. Therefore, the rolling diaphragm seals are generally longer lasting than conventional flat diaphragm seals. Because of the absence of flat diaphragm seals and/or O-ring seals between the firing valve and the housing, the pneumatic gun described hereinabove generally have a longer life without failure than guns which have either of these types of seals.

Another advantage of this gun is that there are not close tolerance to be held between the firing valve and the housing within which it is movable. The firing valve is sealed from the housing by the convolution of the rolling seal which is very tolerant of dimensional inaccuracies As a consequence, the gun may be manufactured less expensively than guns which require close tolerances and very fine finishes to be maintained between wear surfaces of the firing valve and the housing within which the valve is movable.

Yet another advantage of the firing valve described hereinabove is that it has no firing valve seals movable over an exhaust port of the gun as the firing valve moves from an exhaust port open to an exhaust port closed position. A seal is particularly subject to wear at the point at which it moves over an open port. Since the firing valve of this gun has no seals which move over and contact the holes or ports, this seal wear point is eliminated.

Figure 5:
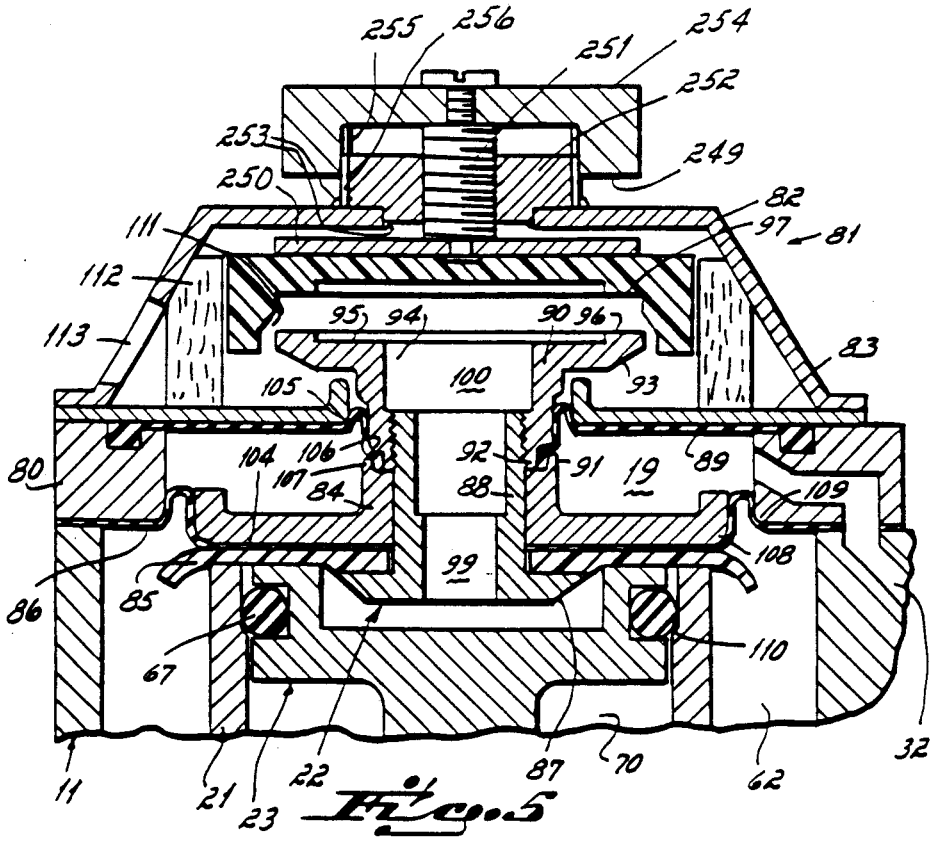

With reference now to FIG. 5, there is illustrated yet another embodiment of this invention. The gun of this modification is identical to the gun disclosed in the modification of FIGS. 1–4, except that the elastomeric exhaust seal 97 is made adjustable relative to the top lip 96 of the exhaust stem 90 so as to enable the power output of the gun to be varied. By varying the size of the fully open gap 111 between the open exhaust stem 90 and the exhaust valve 97, the velocity with which the piston 23 moves downwardly may be controlled and thereby varied. To that end and according to this modification, the elastomeric exhaust valve 97 is fixedly attached to the underside of an adjustment plate 250, which plate is movably mounted on the underside of the deflector cap 82. The adjustment plate 250 is secured to the bottom of an adjustment screw 251. This screw 251 is threaded through a nut 252 which is welded to the top surface of the deflector cap 82 as indicated by the numeral 253. Splined to the top of the adjustment screw 251 is a plastic knob or handle 254 having a downwardly extending outer lip 249. This lip has a knurled inner edge 255 engageable with a knurled edge 256 on the periphery of the nut 252. When the knob 254 is rotated, the screw 251 to which it is splined also rotates relative to the stationary nut 252. Screw 251 is thereby moved axially relative to the stationary nut 252 and the adjustment plate 250 secured to the bottom of the screw 251 is moved axially with it. Thus, the elastomeric exhaust valve 97 attached to the underside of adjustment plate 250 is moved axially in response to rotation of knob 254. The adjustment plate 250 and attached exhaust valve 97 are held in an adjusted position by the knurled surfaces 255 and 256 on the knob 254 and nut 252, respectively.

The pneumatic gun modification which is fragmentarily illustrated in FIG. 5 has all of the advantages of the gun of FIGS. 1–4. Additionally though, this modification has the advantage of enabling the power output of the gun to be varied as a consequence of adjustment of the exhaust valve 97 relative to the valve stem lip 96.

It will be understood by anyone skilled in the art that, in use, gun 10 can assume any orientation. Thus, terms such as upper, lower, downward, upward, and the like, used herein and in the claims, are used in association with the accompanying figures solely for purposes of clarity of description.

while I have described only two embodiments of my invention, persons skilled in the art to which this invention relates will appreciate numerous changes and modifications which may be made without departing from the spirit of my invention. Therefore, I do not intend to be limited except by the scope of the following appended claims.

I claim:

1. A fastener driving tool having a firing valve mounted therein for selectively introducing a sufficient volume of pressurized gas into an expansible chamber for moving a piston therein to drive a fastener, and having a firing valve chamber for selective connection between the atmosphere to open the firing valve for operating the tool to drive a fastener, and a source of gas above atmospheric pressure to maintain the firing valve in closed position, the improvement comprising:

first and second rolling seals disposed in said tool and defining between them said firing valve chamber, said first and second rolling seals each having a convolution disposed between said firing valve and adjacent surfaces of said tool, said first and second rolling seals independently supporting said firing valve for movement in said tool.

2. A fastener driving tool as in claim 1 wherein said firing valve comprises at least an exhaust stem and a piston, said exhaust stem and piston being separable and each defining opposed compression surface means for securing one of said rolling seals to said firing valve.

3. A fastener driving tool as in claim 1, wherein said firing valve includes two separable elements, one of said rolling seals having an inner portion sealingly captured between said two separable elements.

4. A fastener driving tool as in claim 1, wherein said firing valve includes a center post, a piston and an exhaust stem threaded onto said center post, said piston and said exhaust stem having surfaces for compressing and sealing inner portions of said rolling seals to said firing valve.

5. A fastener driving tool as in claim 1 wherein said first one of said seals has a convolution adjacent an inner edge of said first seal and said second seal has a convolution disposed proximate an outer edge of said second seal.

6. A fastener driving tool as in claim 5 wherein the convolution in said first seal is on one diameter and the convolution in said second seal is a greater diameter.

7. A firing valve for use in a fastener driving tool of the type having a cylinder, and a reciprocal piston therein, said firing valve for selectively sealing a cylinder from a source of pressurized air, or moving away from said cylinder to open said cylinder to pressurized air above said piston for driving it, when said firing valve is combined with a fastener driving tool, said firing valve including:

an exhaust valve stem having an exhaust bore therein;

a first rolling seal;

a second rolling seal;

a firing valve chamber defined between said seals;

said first rolling seal sealing said firing valve chamber from said cylinder and from said exhaust bore in said exhaust stem;

said second rolling seal sealing said firing valve chamber from atmosphere; and said firing valve chamber being selectively operationally connected to atmosphere or to a source of pressurized air at a pressure above that of the atmosphere for respectively firing a fastener driving tool or preventing firing of a fastener driving tool, said first and second rolling seals each having a convolution disposed between said firing valve and adjacent surfaces of said tool such that said rolling seals support and guide said firing valve for movement in said tool independently of all surfaces in said tool.

8. An expansible chamber apparatus disposed in a housing and including:

A firing valve for sealing said expansible chamber from a firing valve chamber, and for selectively opening said expansible chamber to operating pressure air;

said firing valve including reciprocable means for selectively engaging a port disposed between a pressure air source and said expansible chamber and sealing same from said pressure air source; and, an exhaust passage means extending through said reciprocable engaging and sealing means for selectively communicating between said expansible chamber and an area at a lower pressure than said pressure air source when said reciprocable means is in a position sealing said expansible chamber from said pressure air source;

wherein said reciprocable engaging and sealing means includes an exhaust valve stem having a bore comprising a portion of said exhaust passage means; and wherein said firing valve and said firing valve chamber, are disposed in said housing;

said apparatus further including:

a rolling diaphragm seal operably sealing said firing valve to said housing, sealing said firing valve chamber from said exhaust passage and sealing said expansible chamber from said firing valve chamber within said housing;

a second rolling diaphragm seal operatively sealing said firing valve chamber from said lower pressure area when said reciprocable means is moved to engage and seal said expansible chamber from said pressure air source; and said firing valve chamber being selectively connectable to the atmosphere or to a source of pressure greater than that of said atmosphere, said rolling diaphragm seals each having a convolution disposed between said firing valve and adjacent elements of said apparatus, said seals independently supporting said firing valve in said apparatus for movement therein.

9. A gas operated fastener driving tool comprising:

a housing;

an upstanding cylinder disposed within said housing and defining with said housing a housing chamber adapted to receive gas under pressure;

a piston slidably mounted within said cylinder and provided with a fastener driver on the lower side thereof facing said lower cylinder end, said piston in response to pressurized gas supplied to the upper side of said piston being driven from a retracted position at the upper end of said cylinder to a driven position at the upper end of said cylinder to a driven position at the lower end of said cylinder;

valve means including a firing valve and a remote trigger valve for controlling the introduction and exhaust of pressurized gas to and from the upper end of said cylinder above said piston;

a firing valve chamber located within said housing and above said cylinder, said firing valve being reciprocable toward and away from said cylinder within said firing valve chamber to control the flow of gas under pressure from said housing chamber into the top side of said cylinder and from the top side of said cylinder to atmosphere;

an exhaust chamber located above and sealed from said firing valve chamber;

a pair of spaced rolling diaphragm seals, defining between them said firing valve chamber, both of said seals being connected to said firing valve and to said housing;

said firing valve chamber being selectively connectable to the atmosphere for firing the tool or to a source of pressure above that of atmospheric to prevent firing of the tool, one of said seals sealing said firing valve chamber from said exhaust chamber; and another of said seals sealing said firing valve chamber from said housing chamber and from said exhaust chamber when said firing valve is spaced from said cylinder, said rolling diaphragm seals each having a convolution disposed between said firing valve and adjacent surfaces of said tool, said seals independently supporting said firing valve for movement in said tool.

10. A gas operated fastener driving tool comprising:

a housing;

an upstanding cylinder disposed within said housing and defining with said housing a housing chamber adapted to receive gas under pressure;

a piston slidably mounted within said cylinder and provided with a fastener driver on the lower side thereof facing said lower cylinder end, said piston in response to pressurized gas supplied to the upper side of said piston being driven from a retracted position at the upper end of said cylinder to a driven position at the lower end of said cylinder;

valve means including a firing valve and a remote trigger valve for controlling the introduction and exhaust of pressurized gas to and from the upper end of said cylinder above said piston;

a firing valve chamber located within said housing and above said cylinder, said firing valve being reciprocable within said firing valve chamber from a lower position sealingly engaged with the top of said cylinder to a raised position remote from the top of said cylinder;

an exhaust chamber located above and sealed from said firing valve chamber;

an exhaust valve stem located within said exhaust chamber, said exhaust valve stem being attached to and reciprocable with said firing valve;

an exhaust bore extending through said firing valve and said exhaust valve stem from the underside of said firing valve to the top side of said exhaust valve stem;

wherein said firing valve is sealingly connected to said housing by two spaced rolling diaphragm seals, said firing valve chamber being located between said rolling diaphragm seals, being sealed from said housing chamber by one of said rolling diaphragm seals, and being selectively connectable to atmosphere or to a source of pressure above that of atmospheric, said rolling diaphragm seals each having a convolution disposed between said firing valve and adjacent surfaces of said tool.

11. The fastener driving tool of claim 10 wherein the one of said two rolling diaphragm seals sealingly separates said firing valve chamber from said housing chamber.

12. The fastener driving tool of claim 10 wherein said firing valve includes separable means for sealing connection to said respective seals.

* * * * *